US006386129B1

(12) United States Patent
Uto

(10) Patent No.: US 6,386,129 B1
(45) Date of Patent: May 14, 2002

(54) NAME CLOTH FEED DEVICE

(75) Inventor: Yoshitsugu Uto, Aichi (JP)

(73) Assignee: Barudan Sewing Machine Co., Ltd., Aichi (JP)

( * ) Notice: Subject to any disclaimer, the term of this patent is extended or adjusted under 35 U.S.C. 154(b) by 0 days.

(21) Appl. No.: 09/485,499

(22) PCT Filed: Aug. 10, 1998

(86) PCT No.: PCT/JP98/03565

§ 371 Date: Jun. 19, 2001

§ 102(e) Date: Jun. 19, 2001

(87) PCT Pub. No.: WO99/09240

PCT Pub. Date: Feb. 25, 1999

(30) Foreign Application Priority Data

Aug. 19, 1997 (JP) ..... 9/222462

(51) Int. Cl.[7] ..... D05B 3/20; D05B 27/10; D05B 35/06

(52) U.S. Cl. ..... 112/104; 112/152; 112/470.33; 112/304

(58) Field of Search ..... 112/152, 113, 112/470.05, 470.33, 129, 470.34, 2.1, 470.16, 147, 104, 304

(56) References Cited

U.S. PATENT DOCUMENTS 3,792,672 A * 2/1974 Friedman et al. ..... 112/152
4,287,841 A * 9/1981 Rovin ..... 112/470.33 X
4,706,585 A * 11/1987 Schuurmans ..... 112/152
4,813,361 A * 3/1989 Yunoki ..... 112/470.3
6,209,468 B1 * 4/2001 Marcangelo et al. ..... 112/2.1

* cited by examiner

*Primary Examiner*—Ismael Izaguirre
(74) *Attorney, Agent, or Firm*—Lorusso & Loud

(57) ABSTRACT

There is described a tag feeder that feeds tags one after another from a tag strip comprising numerous tags and having sensor marks and cut lines onto side edges of fabric materials placed on a work table. The tag feeder comprises a pair of feed rolls to pinch and draw in the tag strip, a mark sensor to read the sensor marks on the tag strip, a tag cutter to cut off the tags, a tag pusher to push each tag portion sideways, a tag receiver to receive and sandwich each tag portion with a feed belt. Each sandwiched and separated tag is then fed on a side edge of the fabric material on the work table.

2 Claims, 13 Drawing Sheets

(A)

(B)

NAME CLOTH FEED DEVICE

TECHNICAL FIELD

This invention relates to a tag feeding system or tag feeder to be attached to or mounted on an edge stitching machine to feed fabric tags (for indicating fabric material, manufacturer, brand name, washing conditions, etc.) onto a side edge of a fabric product such as a towel or scarf to be sewn thereon.

BACKGROUND ART

A tiny fabric piece (2 cm×4 cm or so) of tag is generally fed and sewn on a side edge of a fabric product such as a towel or scarf concurrently with the hem stitching of the towel or scarf. Such a tag may provide information on the quality, manufacturer, washing conditions, etc. of the fabric product.

Japanese Patent Laid-Open Publication No. 63-125289 teaches a tag feeding system, where tags are provided separately in a pile and fed one by one on side edges of fabric products from the tag pile. Feeding tiny tags 2 cm×4 cm or so one by one accurately is no easy task. An improvement was proposed as shown in FIG. 13, where a long train of such tags are prepared to be cut and separated just before their individual attachment onto side edges of fabric products.

Japanese Patent Laid-Open Publication No. 1-121090 teaches a tag feeder for a sewing machine which utilizes such a train of tags. As FIG. 15 shows, a train of tags 100 are fed into a tag receiver 20 provided over an edge stitching apparatus 10 of a sewing machine 1. The train of tags 100 are then cut and individually held by a tag holder 30 provided between the tag receiver 20 and the edge stitching apparatus 10 which includes an actuator 31 having an actuator rod 31*a* where a tag clamp 32 is attached. The tag holder 30 is then turned vertically around a horizontally provided shaft 13 so that the actuator rod 31*a* faces the edge stitching apparatus 10 in order to provide a tag 100 at a time on a side edge of a fabric product.

The tag feeder of Japanese Patent Laid-Open Publication No. 1-121090 was conceived with a view to obviating shortcomings of a conventional tag feeding system. Tags must be fed on side edges of fabric products at right moments as an edge stitching apparatus stitches the side edges of the fabric products, for which each tag must wait for its turn above the stitching apparatus in a position and orientation so as not to hinder the sight of or interfere with the stitching operation of the edge stitching apparatus. The actuator rod of an actuator must be held in a retracted position until the tag is required. A problem peculiar to a conventional tag feeding system is that it requires a "considerable" time for the actuator rod to be ready to feed the tag on a side edge of a fabric product at a precise timing and position and that the accurate adjustment of the tag feeding timing and positioning is very problematical and difficult, especially in a "fast" edge stitching operation.

An object of the tag feeder of the above publication 1-121090 is to obviate the problems associated with such a delay in tag feeding and accurate provision of tags. The tag feeder of the publication holds a tag with a tag holder including an actuator having an actuator rod with a tag clamp on the distal end thereof. The tag holder turns vertically and advances the actuator rod having a tag at the tag clamp toward a side edge of a fabric product where the tag is to be sewn. Advancement of the actuator rod is detected by a positioning sensor and controlled on the way.

The tag feeding system according to Japanese Patent Laid-Open Publication No. 1-121090 is still susceptible to delay in feeding tags as the distance between the stitching apparatus 10 and tag feeder 20 is considerable. And since the tag feeding system is very complicated in structure, the tag feeding system is that much more likely to malfunction, partly due to yarn ravelings or cotton waste produced during the edge stitching operation, especially in a fast-type edge stitching operation.

Japanese Patent Laid-Open Publication No. 7-124356 discloses a tag feeding assistant device to alleviate the foregoing problems. This device facilitates feeding of not only tags but also other product members such as tapes, rubber strings or strips or lace strings to a stitching apparatus of a sewing machine. An aim of this feeding assistant device is to stabilize the feeding amount under a fast stitching operation by preventing excessive feeding through introduction of a one-way clutch. As shown in FIG. 16, an intermediate shaft having two eccentric portions with their phase opposite to each other is provided between a main shaft and a feeder roll shaft. Each eccentric portion is provided with a swing arm. The intermediate shaft is controlled by reduction gears to turn at half the turning rate of the main shaft. This system is capable of adequately coping with a conventional fast stitching operation to a certain degree.

The feeding assistant device of Japanese Patent Laid-Open Publication No. 7-124356, however, will not be able to cope with a very fast hem stitching system. The applicant has previously proposed a towel hem stitching apparatus which is automatic and capable of coping with a very fast hem stitching. The feeding assistant device of the foregoing publication cannot be utilized in the applicant's very fast hem stitching apparatus.

The hem stitching apparatus proposed by the applicant is partially shown in FIG. 14. A towel material 211 is placed on a table 200 with a tag 220 fed precisely along an edge of the towel material 211. The tag 220 and the towel material 211 are pressed against the work table 200 with a press disk 230. The press disk 230 turns on the work table 200 so that, as the four side edges of the towel material 211 are stitched, the tag 220 is sewn concurrently.

FIG. 12 shows in more detail how tags are sewn on side edges of towel materials 210 with the hem stitching apparatus of the applicant, FIG. 12(A) showing stitching of a dual type tag and FIG. 12(B) showing stitching of a single type tag. Such tag sewing requires a precision tag feeding apparatus for quick but accurate positioning and orientation of tags 220 on the towel materials 210 as shown in FIG. 14.

Conventional tag feeders such as shown in FIGS. 15 and 16 require very troublesome and time-consuming adjustment for precise positioning and orientation of tags each time the shape and/or size of tags or fabric products are changed. In addition, such conventional tag feeders will likely interfere with operation of hem stitching apparatus such as introduced by the applicant, rendering utilization of such a conventional tag feeder on the applicant's very fast type hem stitching machine to be very difficult, if not impossible.

Accordingly, it is an object of the present invention to provide a tag feeder that can be utilized in a very fast and precise tag/edge stitching operation.

It is an additional object of the present invention to provide a simple and easy-to-adjust tag feeder as claimed in claim 1, which is capable to smoothly feed tags at a high speed and to be easily adjusted according to the size and/or shape of the tag.

It is an additional object of the present invention to provide a tag feeder as claimed in claim 2, which possesses an additional feature of very accurately feeding tags without interference with an edge stitching machine.

DISCLOSURE OF THE INVENTION

A tag feeder of the present invention is described hereunder using the attached drawings for convenience of description and to assist understanding of the invention.

A tag feeder 100 (as claimed in claim 1) cuts off each tag 220 from an elongated tag strip 220*a*, feeds the tag 220 on a work table 200 mounting a fabric material 211, and makes the tag 220 ready to be sewn on a side edge of the fabric material 211.

As best shown in FIG. 5, the tag feeder 100 comprises a pair of feed rolls 10 for initially drawing the tag strip 220*a*, a mark sensor 20 which reads sensor marks 221 provided at equal intervals on the tag strip 220*a*, a tag cutter 30 which cuts off and separates individual tags 220 from the tag strip 220*a*, a tag pusher 40 which pushes the tag strip 220*a* sideways, and a tag receiver 50 which receives a pushed portion of the tag strip 220*a* and sandwiches the tag portion with a feed belt 51 provided above the tag receiver 50.

The tag feeder 100 set forth above places a tag portion 220 onto the tag receiver 50 as pushed by the tag pusher 40 and then cuts off the tag portion 220 from the elongated tag strip 220*a* with the tag cutter 30. The tag portion 220 is then sent toward a fabric material 211 on the work table 200 with the feed belt 51 and accurately positioned on a side edge of the fabric material to be sewn thereon.

The tag feeder 100 of the present invention is described in more detail hereunder. Tags 220 may be attached to fabric products 210 in a double-ply form as shown in FIG. 12(A) or a single-ply form as shown in FIG. 12(B). The tag feeder 100 of the invention is described first in the case of a double-ply form and then in the case of a single-ply form.

(Double-Ply Form)

There is shown in FIG. 1 a tag feeder 100 for feeding double-ply form of tags which is installed on a hem or edge stitching machine (not shown) proximate to the stitching portion (not shown) or a work table 200 of the edge stitching machine that receives fabric materials 211 to be edge treated. As shown in FIG. 14, the fabric material 211 on the work table 200 is sandwiched and pressed together with a double-ply tag 220 provided on a side edge thereof with a press plate 230, which turns the fabric material 211 on the work table 200 so that all side edges of the fabric material 211 are processed and the double-ply tag 220 is sewn on the side edge concurrently as shown in FIG. 12.

Each tag 220 is to be cut off along a cut line 223 from a tag strip 220*a* as shown in FIG. 13(A) and to be folded along a fold line 224. The tag strip 220*a* is preferably reeled and housed in a tag storage box 60 shown in FIG. 1. An end portion of the tag strip 220*a* is drawn from the storage box 60, run along a machine frame 70, and passed and pinched between a pair of feed rolls 10 as shown in FIG. 6 mounted on an upper portion of the machine frame 70. One of the feed rolls 10 is driven by a pulse motor 11 via a belt means. The pulse motor 11 is controlled by a mark sensor 20 to be described in detail later. The feed rolls 10 are pressed against each other with a pressure cylinder 12 such that the tag strip 220*a* may be smoothly sent forward between the feed rolls 10 without deformation.

The tag strip 220*a* is provided with sensor marks 221 at equal intervals as shown in FIG. 13(A). When a mark 221 is sensed by a mark sensor 20, a signal is generated and transmitted at an appropriate timing to the pulse motor 11 to stop the feed rolls 10. It is preferred that the sensor marks 221 are provided on the cut lines 223 as shown in FIG. 13.

The processes of the tag cutting and folding are described in more detail using FIGS. 6–10. As the tag strip 220*a* is sent forward (downward) with the feed rolls 10 as shown in FIG. 6, the foremost (lowest) sensor mark 221 is detected by the mark sensor 20 and the tag strip 220*a* stops at the position shown in FIG. 7. The cut line 223 and the sensor mark 221 thereon are positioned between a pair of blades of a tag cutter 30 to be cut off therealong.

Then a tag pusher 40 presses the tag strip 220*a* along the fold line 224 and pushes a distal tag strip portion 220 sideways between a tag receiver 50 and a feed belt 51 provided on the tag receiver 50 as shown in FIG. 8 while the tag strip 220*a* is held firmly between the feed rolls 10 which are pressed toward each other by the pressure cylinder 40.

When the tag portion 220 is adequately pushed forward (leftward) with the tag pusher 40 and held firm between the feed belt 51 and the tag receiver 50, the tag pusher 40 retracts and the tag cutter 30 cuts off the tag portion 220 from the tag strip 220*a* along the cut line 223 as shown in FIG. 9, leaving the cut and folded tag 220 between the tag receiver 50 and the feed belt 51. It is noted that the surfaces of the tag receiver 50 and the feed belt 51 are appropriately textured to firmly hold the tag 220 between the feed belt 51 and the tag receiver 50 when the tag pusher 40 retracts in order to prevent dislocation or deformation of the tag 220.

When the tag pusher 40 fully retreats from between the tag receiver 50 and the feed belt 51, and the tag 220 is cut off from the tag strip 220*a*, a rotary cylinder 55 provided in the vicinity of the feed belt 51 drives the feed belt 51 via a belt means to send the folded tag 220 toward the tag sewing section as shown in FIG. 10. The tag 220 is to be finally placed on a side edge of a fabric material 211 placed on the work table 200 shown in FIG. 1.

The distance that the tag pusher 40 can travel forward to push the tag portion 220 on the tag receiver 50 is controlled by a threaded stopper 45 provided under the tag pusher 40 which restricts the movement of the tag pusher 40 at a set position. The stopper 45 is in thread engagement with a threaded stroke controller 44 which extends below and along the tag pusher 40. The rear end of the stroke controller 44 is exposed from the machine frame 70 and provided with a knob so as to be turned with fingers and move the stopper 45 back and forth. Thus, the distance that the tag pusher 40 travels forward can be easily adjusted by turning the knob of the stroke controller 44 according to the shape and/or size of the tag 220 or the position of the work table 200 in relation with the tag feeder 100.

(Single-Ply Form)

When the tag 220 is to be sewn in a single-ply form on a fabric material 211 as shown in FIG. 12(B), the tag feeder 100 functions as shown in FIG. 11. As the single-ply tag 220 (FIG. 13(B)) is shorter than or roughly half the double-ply tag 220 (FIG. 13 (A)), the single-ply tag 220 will eventually be provided in a singly-ply form between the tag receiver 50 and feed belt 51 when pushed therebetween with the tag pusher 40 as shown in FIG. 11.

The tag pusher 40 is then drawn out from between the tag receiver 50 and the feed belt 51, leaving the single-ply tag 220 therebetween. The tag cutter 30 cuts off the tag portion 220 from the tag strip 220*a* along a corresponding cut line 223. There will be no wrinkling on the single-ply tag 220 as there is provided an appropriate measure on the surfaces of the feed belt 51 and the tag receiver 50 to prevent deformation of the tag 220.

The single-ply tag 220 is sent onto the work table 200 by the feed belt 51 and accurately placed on a side edge of a fabric material 211 to be pressed with the press plate 230 together with the fabric material 211.

The tag pusher 40 facilitates feeding of either a single-ply tag 220 or a double-ply tag 220 onto a fabric material 211. Simple adjustment of the forward movement of the tag pusher 40 by means of the stopper 45 and the stroke controller 44 provides adjustment of the tag feeder 100 in accordance with the size and shape of the tag 220.

In addition, by adjusting the lengths as appropriate of the tag receiver 50 and the feed belt 51 as well as the driving range of the rotary cylinder 55 which drives the feed belt 51, the distance that the tag 220 is carried from the tag receiver 50 to a side edge of a fabric material 211 can be adjusted as desired. If desired, the tag receiver 50 and the feed belt 51 may be extended to provide a "long" distance between the work table 200 and the tag receiver 50 so as to prevent any interference between the tag feeder 100 and a hem stitching machine.

A further improvement the tag feeder 100 of the present invention is proposed. In a tag feeder 100 as claimed in claim 2, the tag receiver 50 slants downward toward the work table 200 after the tag portion 220 is cut off from the tag strip 220*a* as shown in FIG. 2 so that the distal end of the tag receiver 50 approaches the work table 200 to more reliably and accurately provide the tag 220 onto a side edge of a fabric material 211.

In the tag feeder 100 shown in FIG. 2, the tag receiver 50 together with the feedbelt 51 is pulled downward by a tilting cylinder 54 such that the tag receiver 50 pivots and slants downward distally. The tag feeder 100 can then feed a tag 220, either a single-ply or double-ply tag 220, on a side edge of a fabric material 211 very reliably.

An advantage expected of such a slanting feature of the tag receiver 50 is that the work table 200 can be held clear of any interference with the tag feeder 100, where without the reclining feature the relative orientation of the distal end of the tag receiver 50 and the work table 200 will more likely generate interference in operation.

Figure 1:
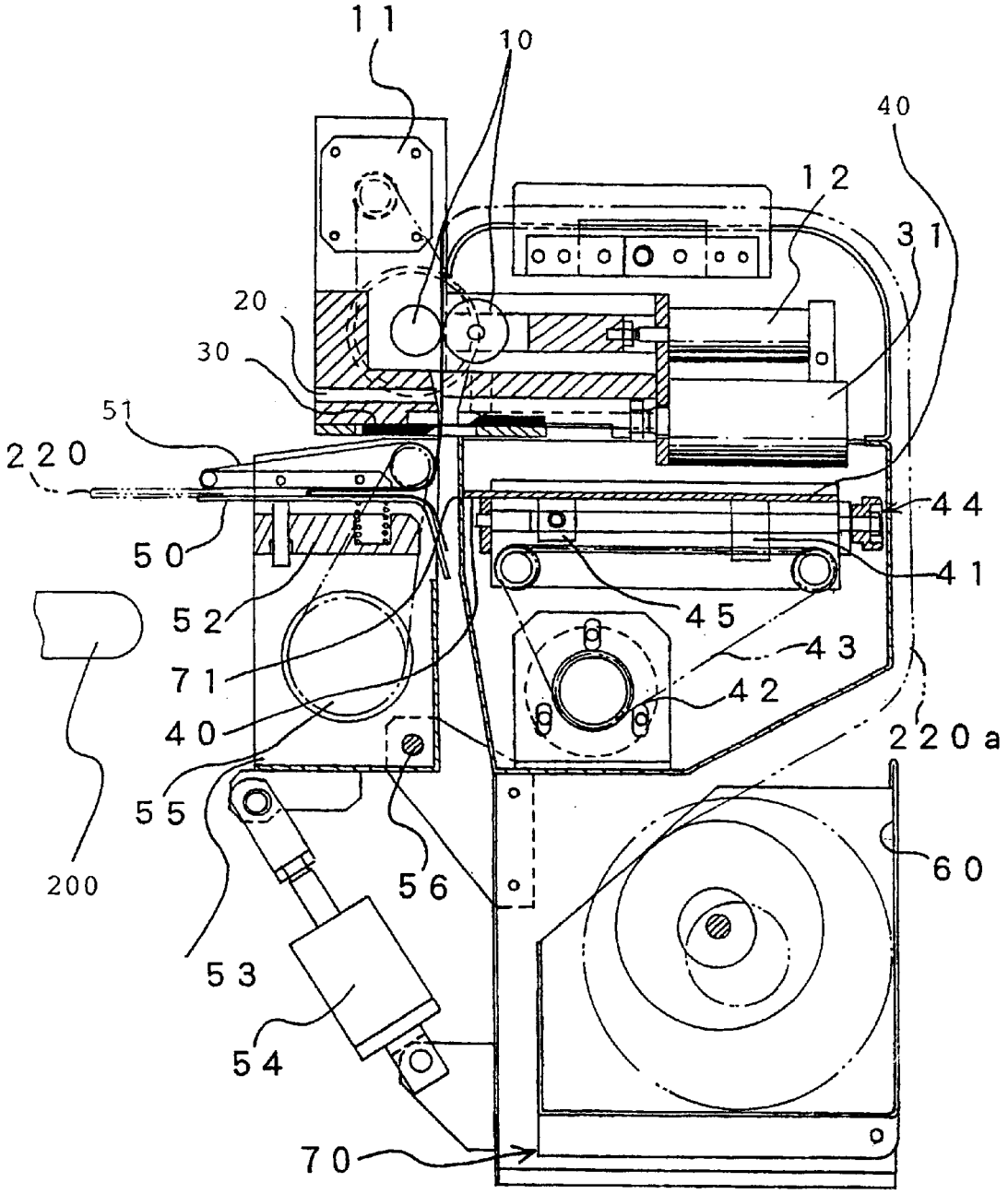
FIG. 1 is a partially sectioned side view of a tag feeder according to an embodiment of the present invention.

The following is the definition of the numerals used throughout the drawings and the specification.

100 . . . tag feeder
10 . . . feed rolls

The following is the definition of the numerals used throughout the drawings and the specification.

11 . . . pulse motor
12 . . . pressure cylinder
20 . . . mark sensor
30 . . . tag cutter
31 . . . cutter cylinder
40 . . . tag pusher
41 . . . carriage table
42 . . . rotation cylinder
43 . . . driving belt
44 . . . stroke controller
45 . . . stopper
50 . . . tag receiver
50*a* . . . spring
50*b* . . . guide pin
51 . . . feed belt
52 . . . support plate
53 . . . cylinder housing
54 . . . tilting cylinder
55 . . . rotary cylinder
56 . . . pivot shaft
60 . . . tag storage box
70 . . . machine frame
71 . . . opening
200 . . . work table
210 . . . fabric product
211 . . . fabric material
220 . . . tag
220*a* . . . tag strip
221 . . . sensor mark
222 . . . tag information
223 . . . cut line
224 . . . fold line
230 . . . press plate

BEST MODE TO CARRY OUT THE INVENTION

Before a tag feeder 100 according to an embodiment of the present invention is described in detail, a tag 220 and tag strip 220*a* used according to the present invention are described in detail.

Figure 13:
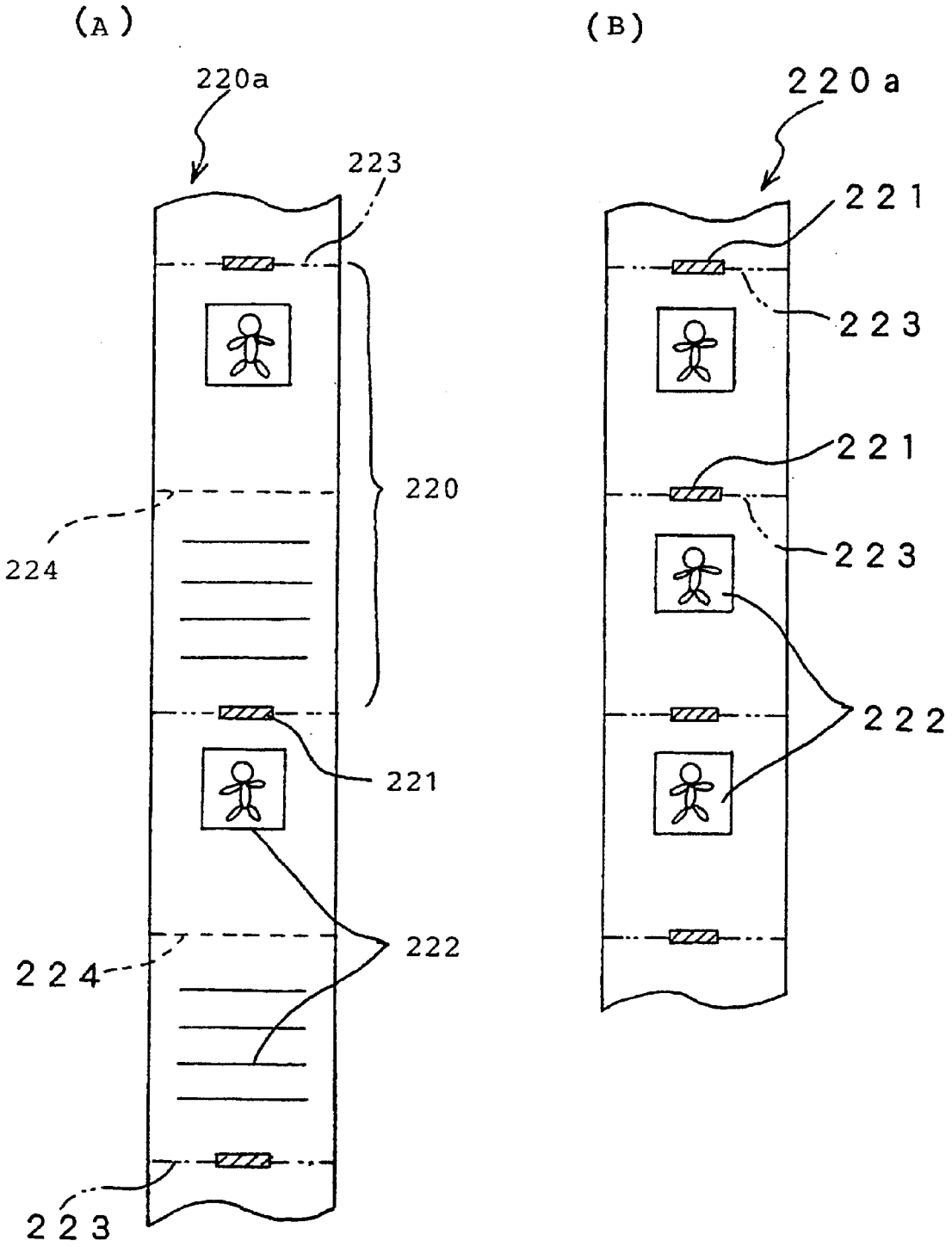
FIG. 13 shows a double-ply tag strip (FIG. 13(A)), and a singly-ply tag strip (FIG. 13(B))
Figure 14:
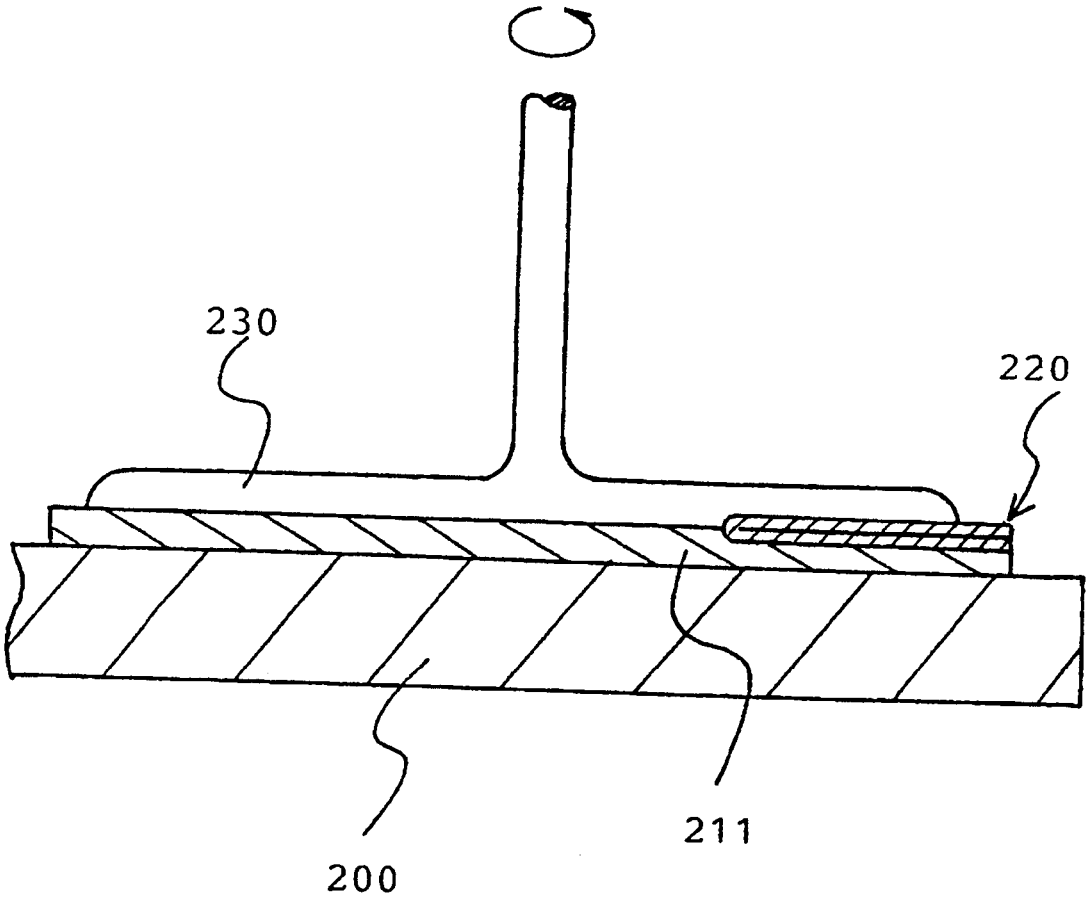
FIG. 14 is a partially sectioned view showing how a tag is placed and pressed with a press plate on a fabric material.
Figure 15:
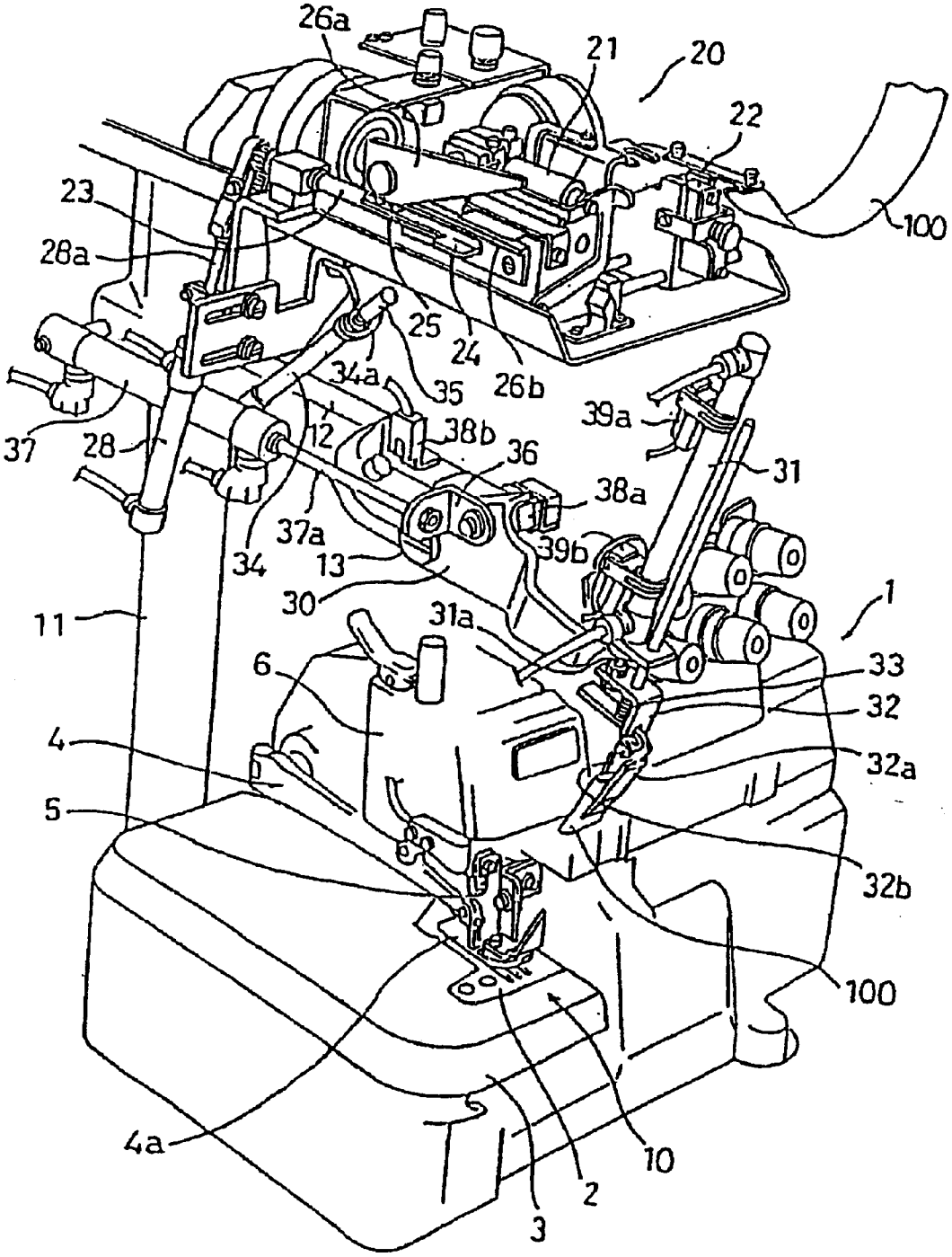
FIG. 15 is a perspective view of a conventional tag feeder.
Figure 16:
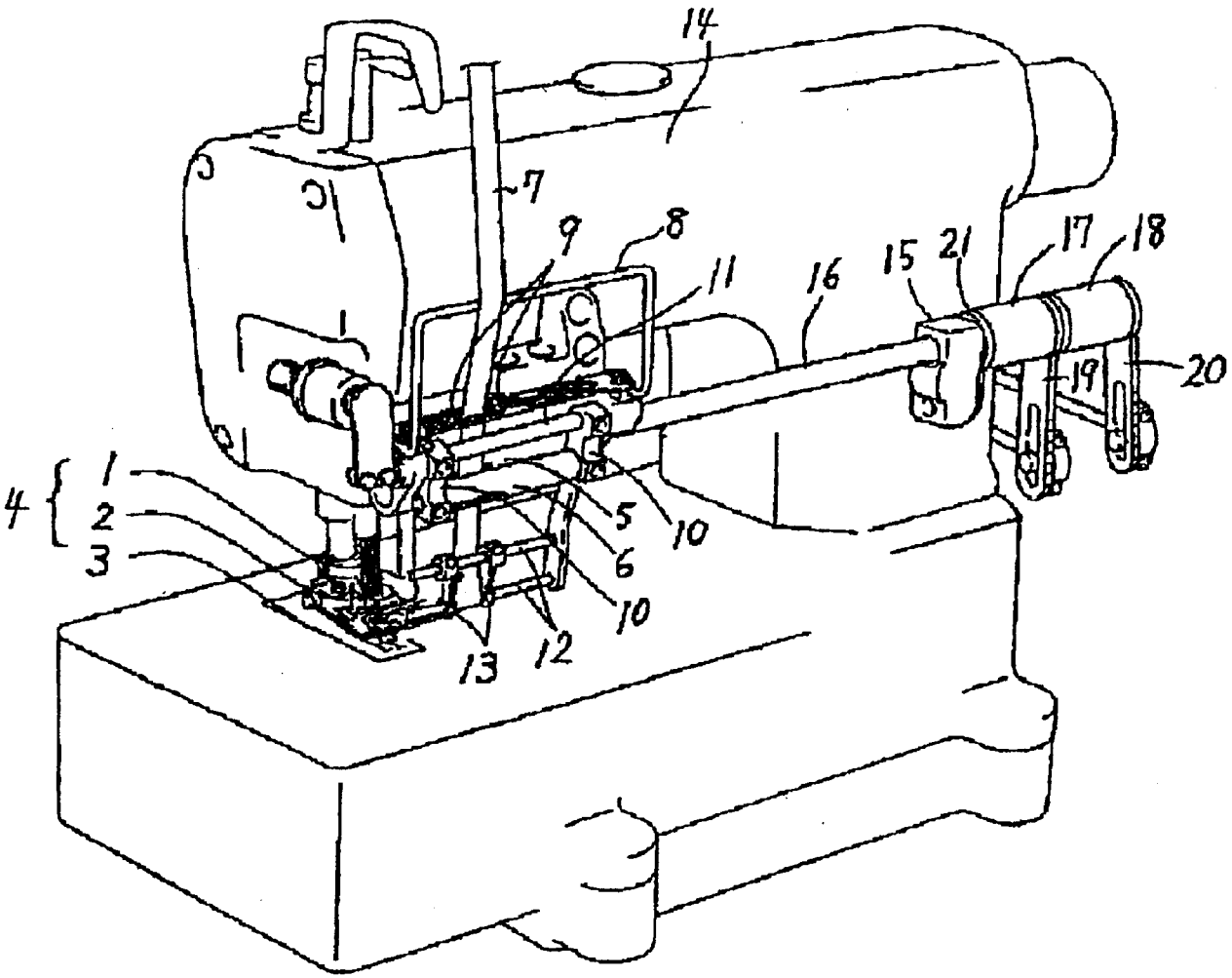
FIG. 16 is a perspective view of another conventional tag feeder.

Tags 220 are provided as an elongated tag strip 220*a* as shown in FIG. 13(A) , for example, which are for double-ply ones. The tag strip 220*a* is reeled and housed in a tag storage box 60 as shown in FIG. 1. Each tag 220 carries tag information 222 and is cut off along a cut line 223 with a tag cutter 30.

As FIG. 13(A) shows, the tag strip 220*a* carries a number of double-ply tags 220. Each cut line 223 is provided with a sensor mark 221 thereon to be detected by a mark sensor 20. The mark sensor 20 stops the tag strip 220*a* so that the tag cutter 30 can cut the tag strip 220*a* along the cut lines 223. The double-ply tags 220 are folded along the fold lines 224 by a tag pusher 40, where the distal edge of the tag pusher 40 contacts.

The tag strip 220*a* shown in FIG. 13(B) carries numerous single-ply tags 220, which are half the size of the double-ply tags 220, and has only cut lines 223 on which sensor marks 221 are provided. The single-ply tags 220 a re cut with the tag cutter 30 as explained in connection with the double-ply tags 220 but the single-ply tags 220 are not folded.

A tag feeder 100 is comprised of, as shown in FIGS. 1–4, a pair of feed rolls 10 which pinch and draw in the tag strip 220*a*, a mark sensor 20 which reads the sensor marks 221 on the tag strip 220*a*, a tag cutter 30 which cuts off the tags 220 from the tag strip 220*a* along the cut lines 223, a tag pusher 40 which pushes each tag portion 220 sideways onto a tag receiver 50 under a feed belt 51. The feed rolls 10, mark sensor 20, tag cutter 30, tag pusher 40 and tag receiver 50 are all mounted on guide pins 50*b*.

Figure 5:
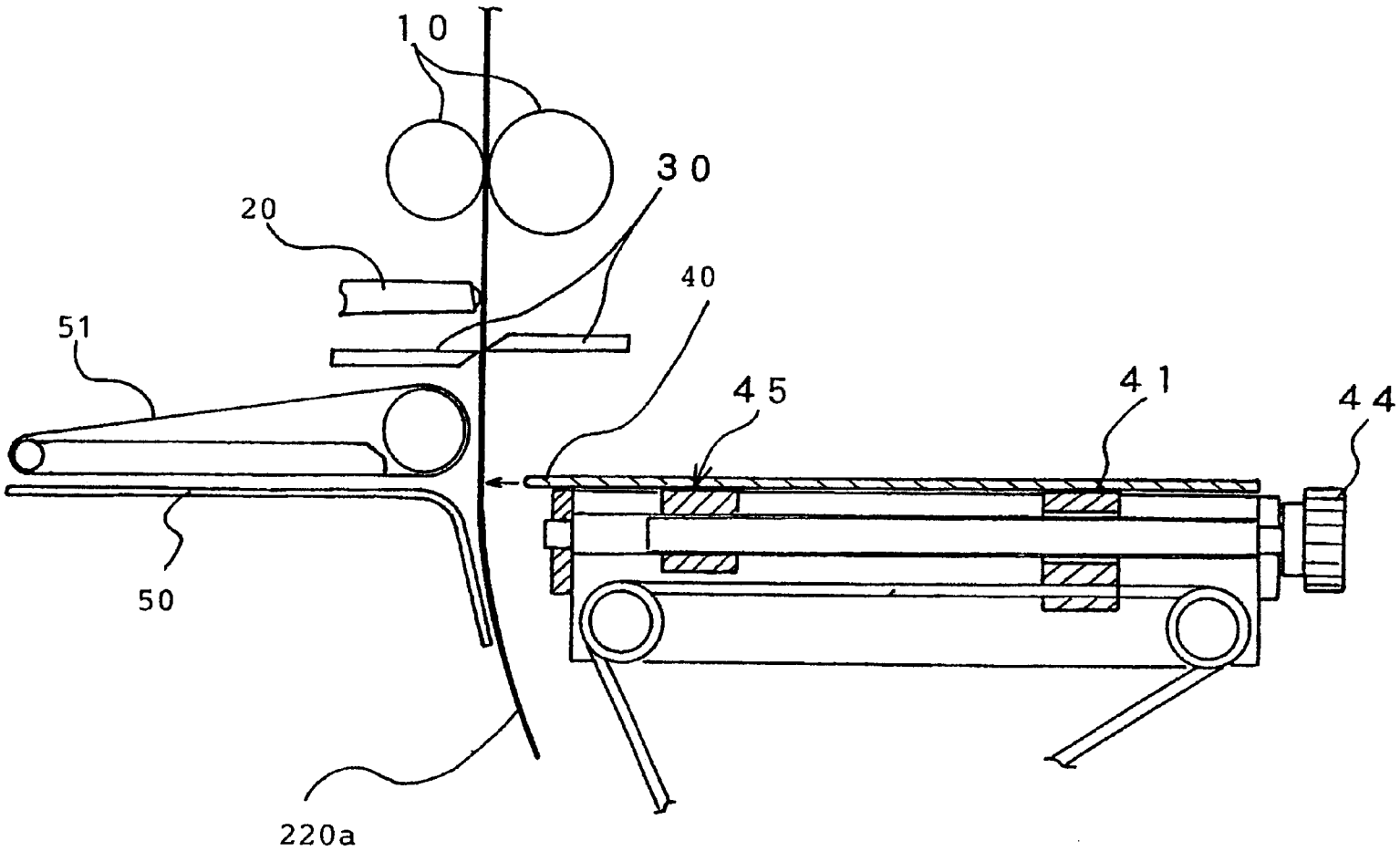
FIG. 5 is a schematic view partially showing the structure of the tag feeder.
Figure 6:
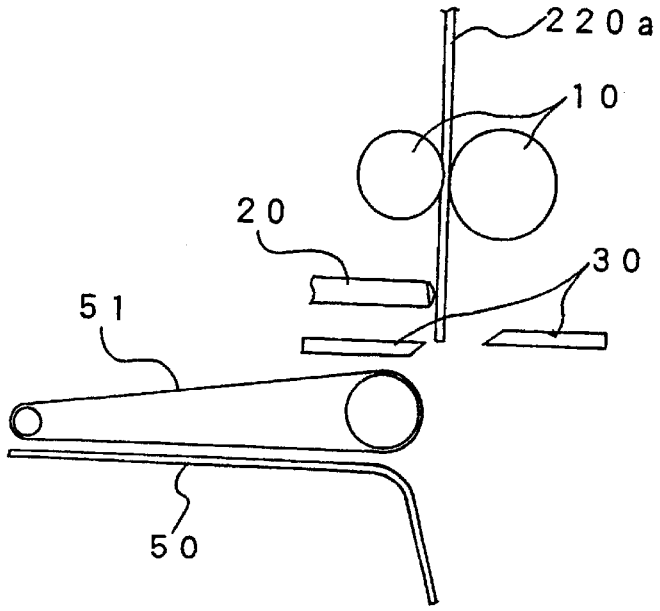
FIG. 6 is a schematic view showing an initial stage of the tag feeder operation for a double-ply tag.
Figure 7:
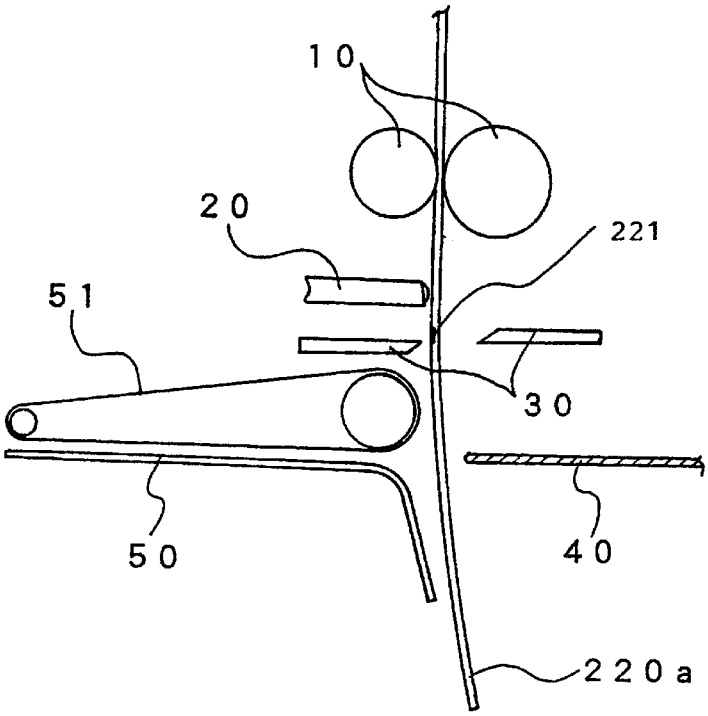
FIG. 7 is a schematic view showing another stage of the tag feeder operation.
Figure 8:
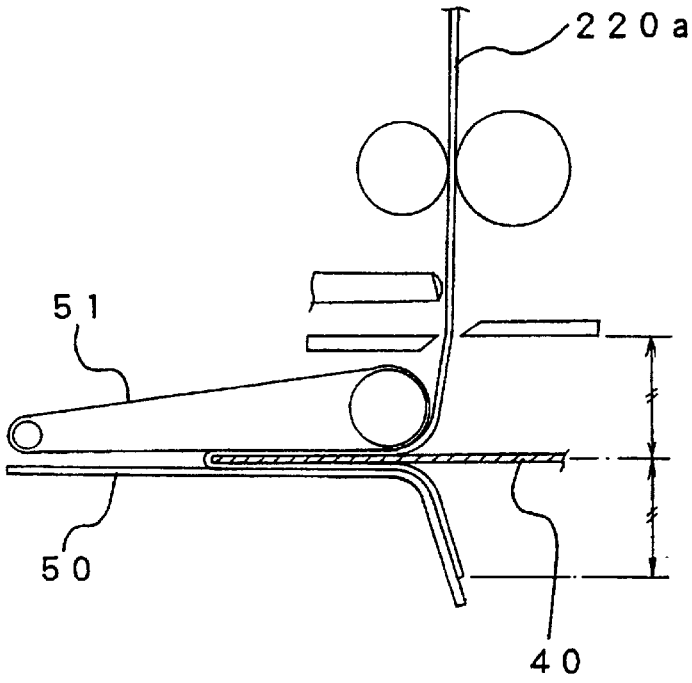
FIG. 8 is a schematic view showing another stage of the tag feeder operation.
Figure 9:
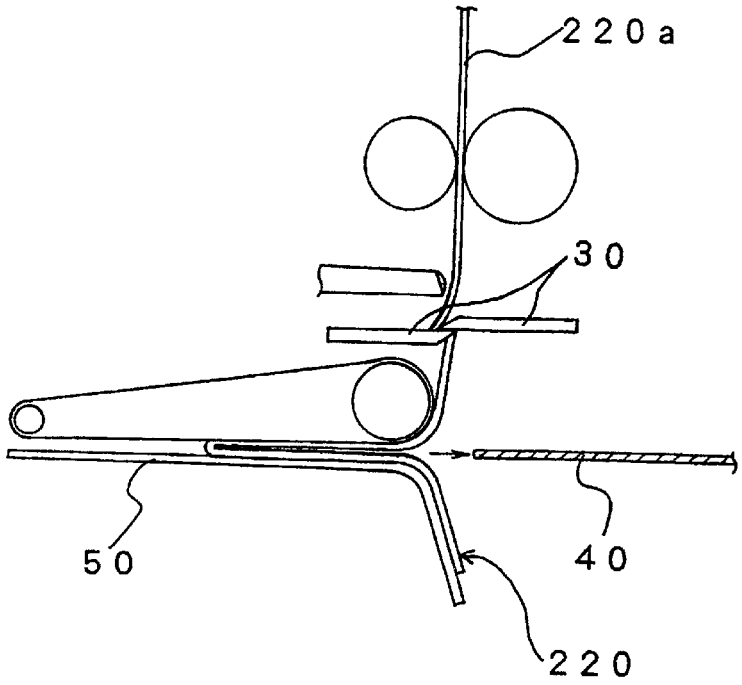
FIG. 9 is a schematic view showing still another stage of the tag feeder operation.
Figure 10:
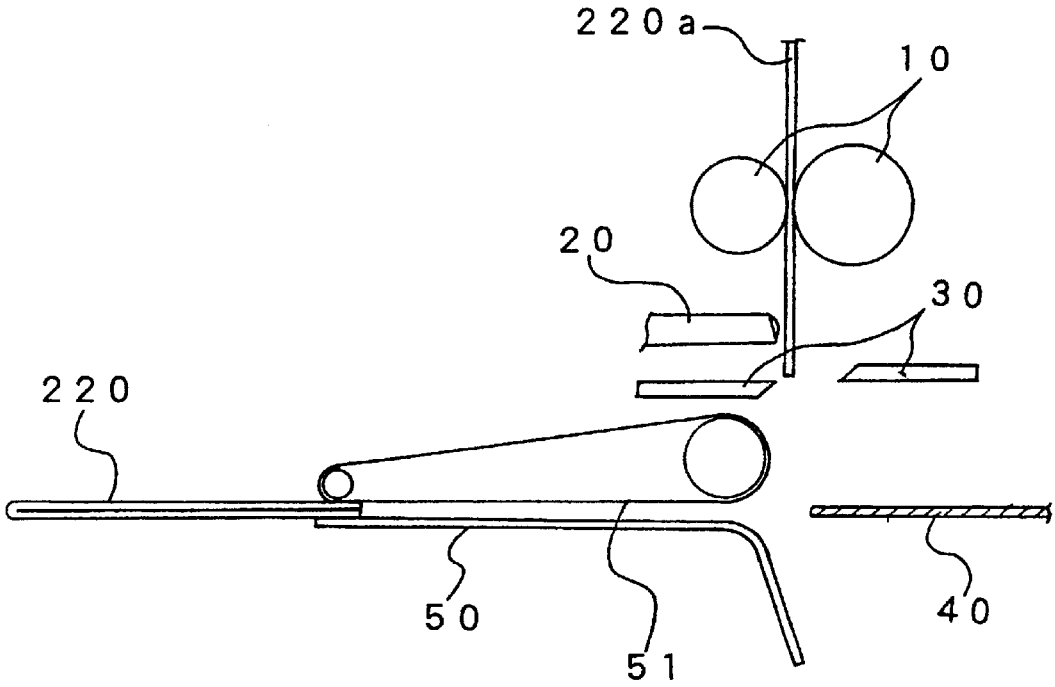
FIG. 10 is a schematic view showing another stage of the tag feeder operation.
Figure 11:
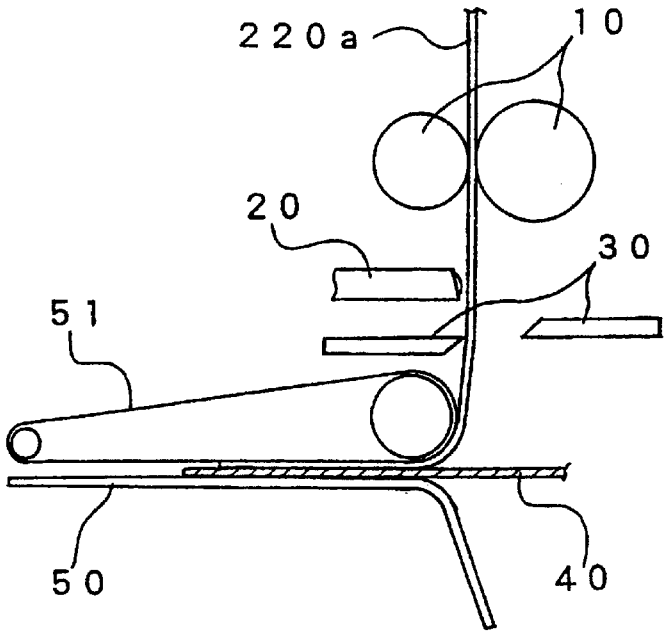
FIG. 11 is a schematic view showing a stage of the tag feeder operation for a single-ply tag.
Figure 12:
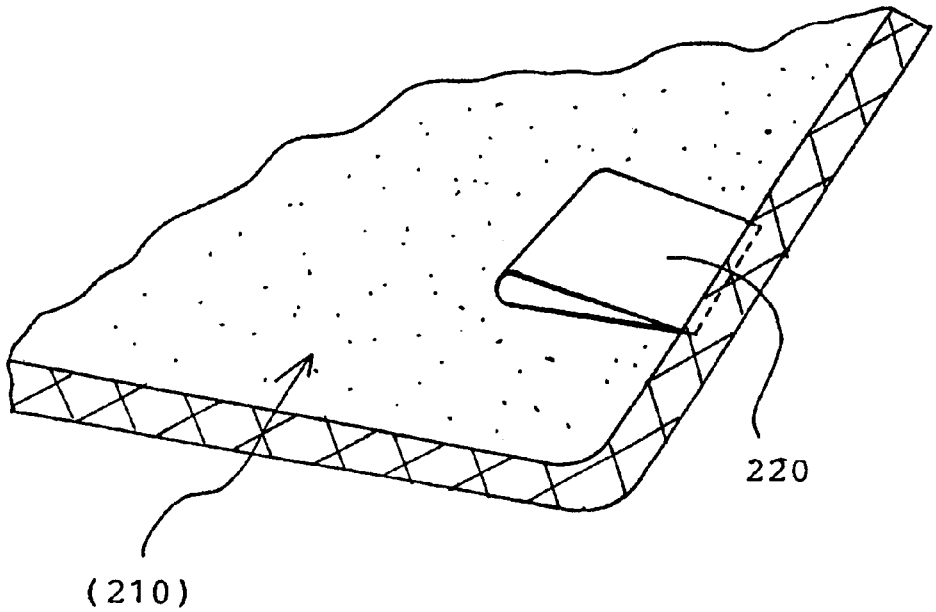
FIG. 12 shows a double-ply tag as sewn on a fabric material (FIG. 12(A)) and a single-ply tag as sewn on a fabric material (FIG. 12(B))
Figure 12:
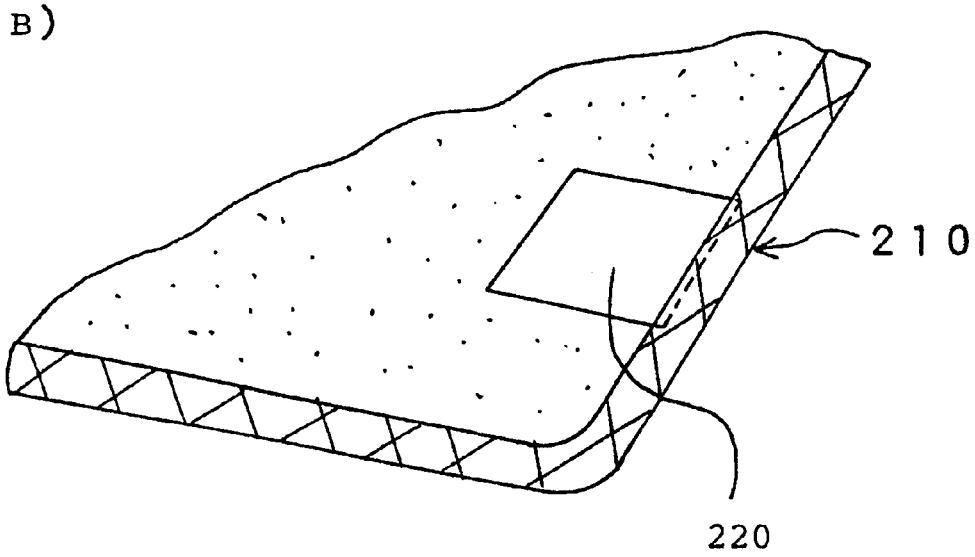

The feed rolls 10 consist of two rolls, one on the left and one on the right in FIG. 1, which are provided on an upper portion of a machine frame 70 as shown in FIGS. 1 and 5. The left roll 10 is driven by a pulse motor 11, and the right roll 10 is pressed toward the left roll 10 with a pressure cylinder 12. The tag strip 220*a* is drawn out of the tag storage box 60 provided at a lower portion of the machine frame 70 and drawn into the feed rolls 10 from behind the machine frame 70 and held firmly between the feed rolls 10.

The mark sensor 20 controls the pulse motor 11 for the left roll 10 by optically reading each sensor mark 221 provided on the tag strip 220*a*. The mark sensor 20 functions to stop the pulse motor 11, which stops movement of the left roll 10 so as to stop movement of the tag strip 220*a* with a delay such that the cut lines 223 are cut along by the tag cutter 30.

The tag cutter 30 may consist of two blades such as shown in FIG. 5. In this embodiment, the left blade may be fixed on the machine frame 70, while the right blade is reciprocally moved by a cutter cylinder 31.

As shown in FIG. 5, below the reciprocally moving cutter blade is provided the tag pusher 40, which is fixed to a carriage table 41 fixed on the machine frame 70. The carriage table 41 receives reciprocal driving forces through a driving belt 43 from a rotation cylinder 42 provided below a stroke controller 44. The carriage table 41 moves together with the tag pusher 40 as driven by the rotation cylinder 42. The forward protrusion movement of the tag pusher 40 from the carriage table 41 is restricted by a stopper 45, whose position is adjusted by the stroke controller 44.

As shown in FIG. 5, the tag pusher 40 is provided on the carriage table 41 which is driven by the rotation cylinder 42. The carriage table 41 is provided with a hole, where the stroke controller 44 is inserted. The stopper 45 is provided along the stroke controller 44 in thread engagement therewith.

The stopper 45 moves forward or backward along the stroke controller 44 as the stroke controller 44 is turned clockwise or counterclockwise to stop the forward movement of the tag pusher 40 at a desired distal position.

The tag receiver 50 is provided to receive a tag portion 220 as pushed by the tag pusher 40 as shown in FIG. 5. The tag receiver 50 is provided moveable vertically to adjust itself to the varying thickness of the tag 220 by means of a coil spring 50*a* and guide pins 50*b* provided on the support 52 shown in FIG. 3.

A feed belt 51 is provided over the tag receiver 50 so as to sandwich the tag portion 220 as pushed in by the tag pusher 40. The feed belt 51 is driven by a rotary cylinder 55 provided below the tag receiver 50 to carry forward the tag 220 cut from the tag strip 220*a* by the tag cutter 30 in order to feed the folded double-ply tag or unfolded single-ply tag 220 onto a side edge of a fabric material 211 placed on the work table 200.

The tag receiver 50 and the feed belt 51 shown in FIG. 1 protrude only slightly from the cylinder housing 53, however, the degree of their protrusion can be adjusted as desired.

Figure 2:
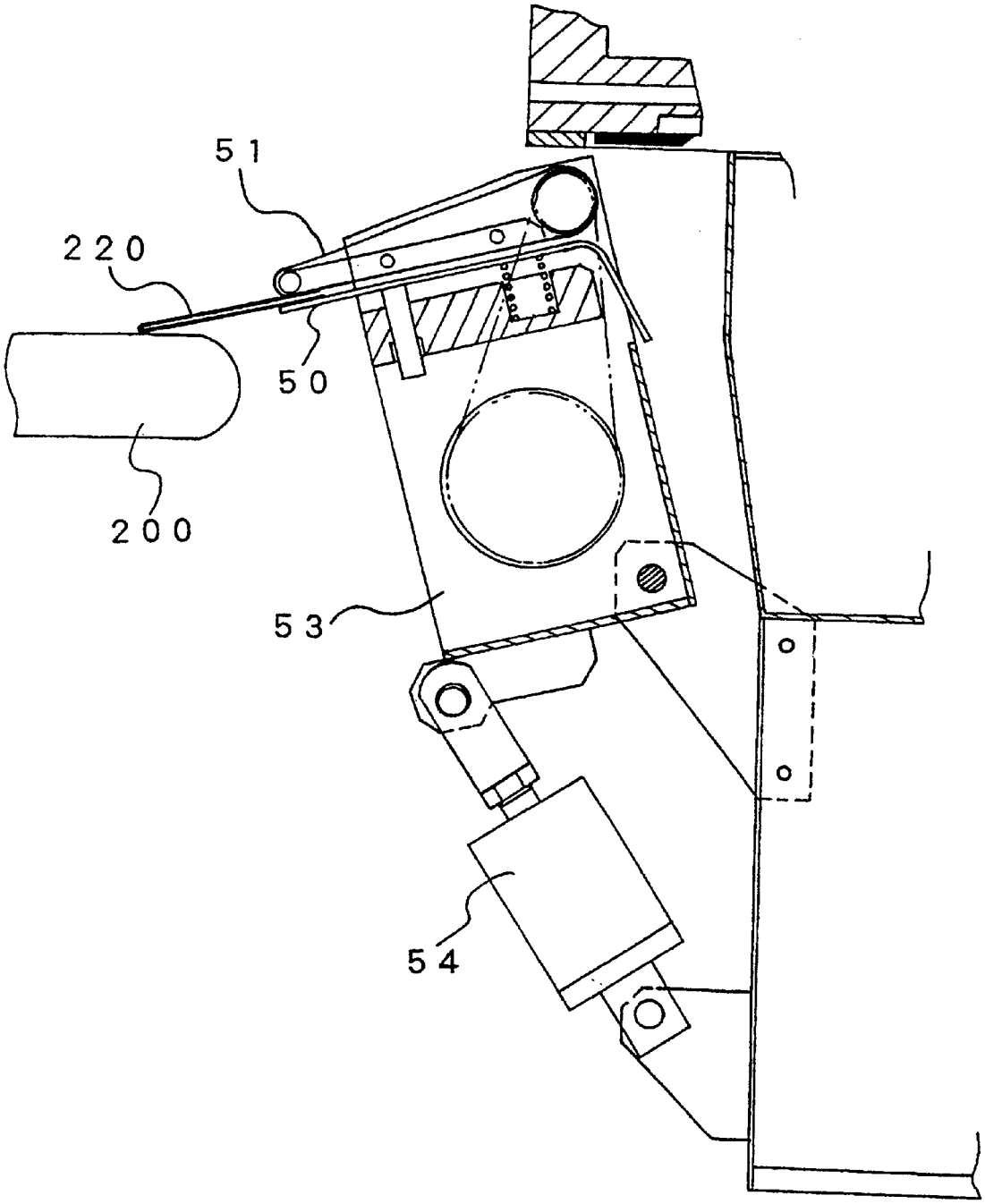
FIG. 2 is a partially enlarged sectional view of the tag feeder, where a tag receiver is shown reclining.
Figure 3:
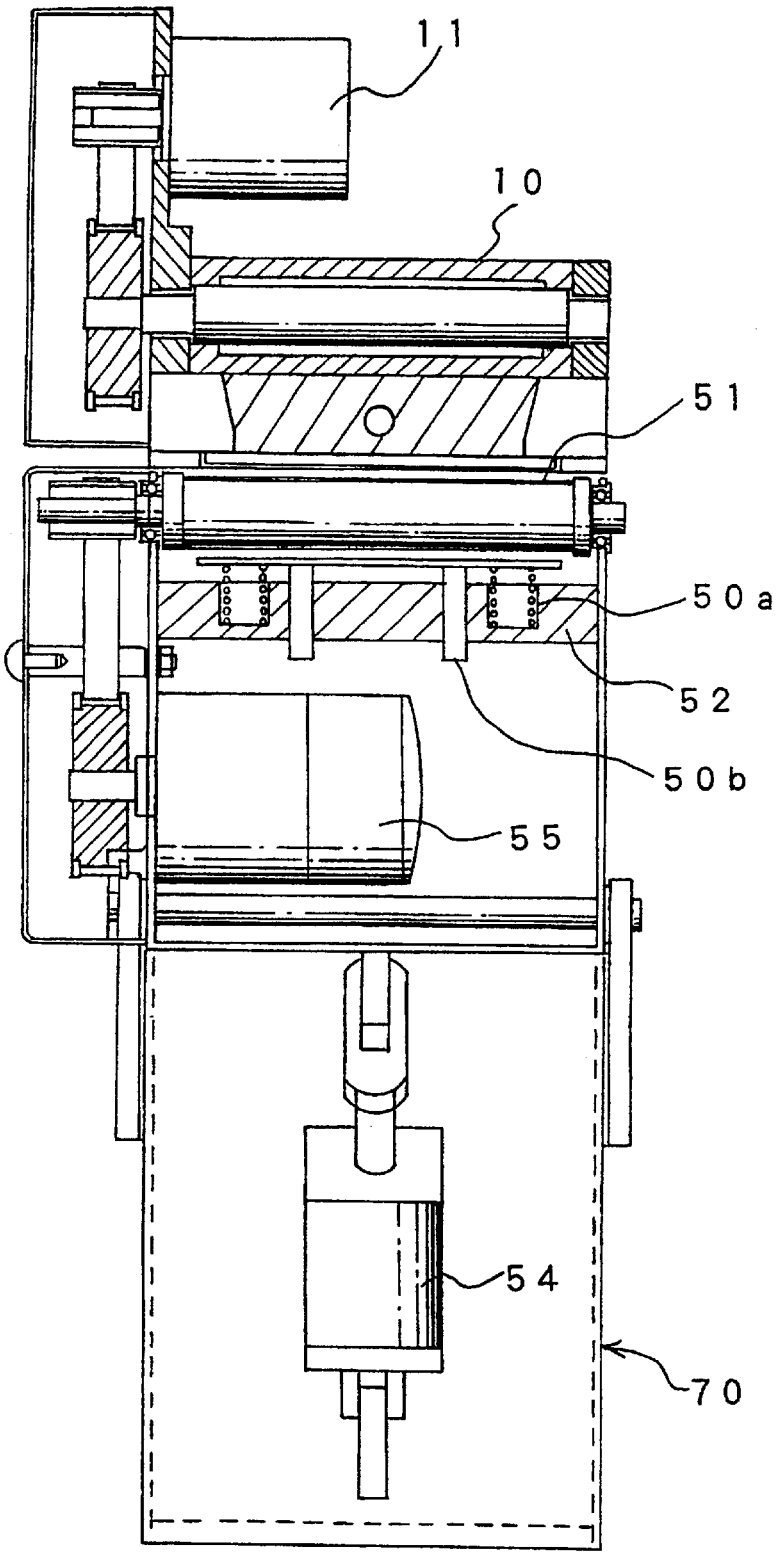
FIG. 3 is a partially sectioned front view of the tag feeder.
Figure 4:
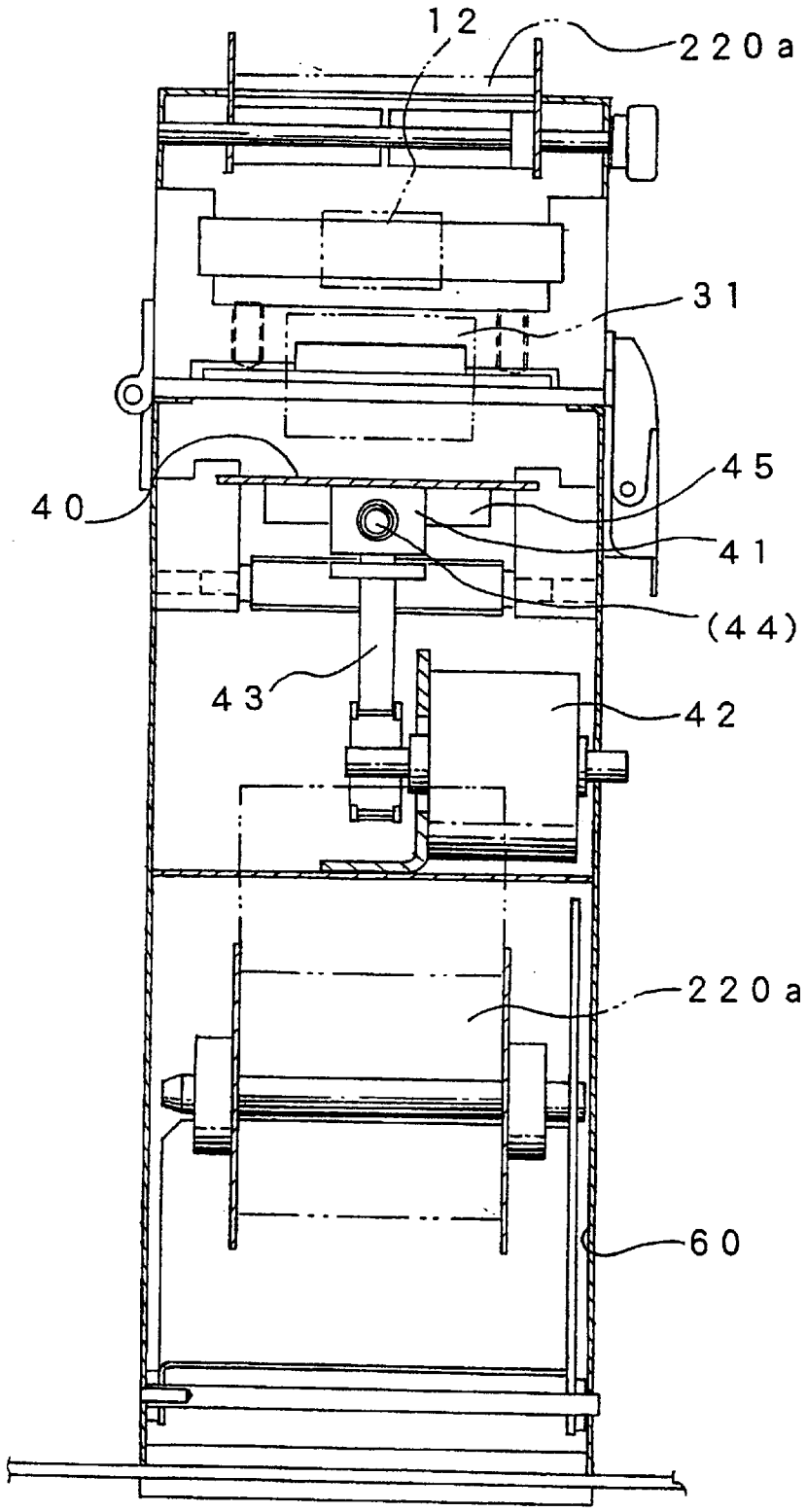
FIG. 4 is a partially sectioned back view of the tag feeder.

The cylinder housing 53 houses the rotary cylinder 55 and mounts the feed belt 51 and the tag receiver 50, which is pivotally provided about a pivot shaft 56 as shown in FIG. 1. The cylinder housing 53 pivots about the pivot shaft 56 together with the feed belt 51 and the tag receiver 50 as pulled by a tilting cylinder 54 so that the feed belt 51 and the tag receiver 50 incline forwardly as shown in FIG. 2.

INDUSTRIAL UTILIZATION OF THE INVENTION

The tag feeder 100 as claimed in claim 1 cuts off each tag 220 (double-ply or singly ply) from a tag strip 220*a* and sends the cut tag 220 one after another onto a work table 200 where a fabric material 211 is placed one after another to be edge treated or stitched. Each tag 220 is concurrently sewn on a side edge of the fabric material to produce a final fabric product such as a handkerchief, towel, etc.

The tag feeder 100 of the present invention is characterized in that it comprises a pair of feed rolls 10 to pinch and draw in a tag strip 220*a* comprising numerous tags 220, a mark sensor 20 to detect sensor marks 221 provided on the tag strip 220*a* at equal intervals, a tag cutter 30 to cut off the tags 220 individually, a tag pusher 40 to push each tag portion sideways onto a tag receiver 50 before its cutting off, and a feed belt 51 to sandwich the tag 220 with the tag receiver 50.

The tag feeder 100 of the present invention can smoothly and speedily feed tags 220 and is adjustable according to the size and/or shape of the tag or fabric material.

The tag feeder 100 as claimed in claim 2 can recline the tag receiver 50 together with the feed belt 51 just before the tag 220 is fed onto a side edge of a fabric material 211 on the work table 200. The tag feeder 100 thus constituted can more accurately and reliably feed tags 220 than the one claimed in claim 1, and effectively eliminate physical interference between machine elements.

What is claimed is:

1. A tag feeder to cut off tags one after another from a tag strip having sensor marks and cut lines, and feed the cut tags one after another onto side edges of fabric materials placed one after another on a work table so as to be sewn on the side edges as said edges of the fabric materials are stitched, comprising:

a pair of feed rollers to pinch and draw in a tag strip a;

a mark sensor to read sensor marks provided on the tag strip at equal intervals;

a tag cutter to cut off tags along cut lines provided on the tag strip at equal intervals, a tag pusher to push a distal tag portion of the tag strip sideways, a tag receiver to receive said distal tag portion pushed sideways by said tag pusher, and a feed belt provided over said tag receiver to sandwich the tag portion with said tag receiver, the feed belt feeding the tag cut off from the tag strip onto a side edge of a fabric material to be edge treated.

2. The tag feeder as claimed in claim 1 wherein said tag receiver inclines downward toward a fabric material placed on a work table just before the feeding the tag onto a side edge of the fabric material.

* * * * *